US005090327A

United States Patent [19]

Bilgeri

[11] Patent Number: 5,090,327

[45] Date of Patent: Feb. 25, 1992

[54] CARTRIDGE WITH FLASH TUBE

[75] Inventor: Elmar Bilgeri, Steyr, Austria

[73] Assignee: Steyr-Daimler-Puch AG, Vienna, Austria

[21] Appl. No.: 654,786

[22] Filed: Feb. 11, 1991

[30] Foreign Application Priority Data

Feb. 27, 1990 [AT] Austria ..... 451/90

[51] Int. Cl.[5] ..... F42B 5/00

[52] U.S. Cl. ..... 102/430; 102/470

[58] Field of Search ..... 102/204, 430, 470

[56] References Cited

U.S. PATENT DOCUMENTS

| | | | |
|---|---|---|---|
| 45,666 | 12/1864 | Yates | 102/430 |
| 52,370 | 1/1866 | Smith | 102/430 |
| 52,818 | 2/1866 | Berdan | 102/430 |
| 58,800 | 10/1866 | Fitch | 102/470 |
| 62,283 | 2/1867 | Milbank | 102/470 |
| 180,840 | 8/1876 | Bull | 102/470 |
| 398,823 | 3/1889 | Emmens | 102/430 |
| 2,269,316 | 1/1942 | O'Neil | 102/470 |
| 2,430,888 | 11/1947 | Regad et al. | 102/204 |
| 3,288,066 | 11/1966 | Stadler et al. | 102/430 |
| 3,312,168 | 4/1967 | Stadler et al. | 102/204 |
| 4,149,465 | 4/1979 | Verkozen | 102/470 |
| 4,572,078 | 2/1986 | Bell . | |
| 4,763,577 | 8/1988 | Romer et al. | 102/430 |

FOREIGN PATENT DOCUMENTS

| | | | |
|---|---|---|---|
| 194343 | 1/1908 | Fed. Rep. of Germany | 102/470 |
| 1277706 | 9/1968 | Fed. Rep. of Germany . | |
| 1296998 | 9/1969 | Fed. Rep. of Germany . | |
| 2553717 | 10/1976 | Fed. Rep. of Germany . | |
| 3226269 | 2/1984 | Fed. Rep. of Germany . | |
| 3701145 | 8/1987 | Fed. Rep. of Germany | 102/470 |
| 1535733 | 12/1978 | United Kingdom . | |

*Primary Examiner*—Harold J. Tudor

*Attorney, Agent, or Firm*—Marmorek, Guttman & Rubenstein

[57] ABSTRACT

A cartridge comprises a cartridge case having a bottom, a top, and a hollow interior, the top being open and receiving a projectile, and the hollow interior containing a propellant charge. A metal ignition tube extends from a primer cap on the bottom of the cartridge case for about one-third the length of the cartridge case. The metal ignition tube terminates in an open end. A detonating agent is contained within the metal ignition tube, but does not completely fill it. An empty channel is formed in the propellant charge and extends from the open end of the metal ignition tube to within proximity of the projectile. Preferably, the empty channel is constituted by a closed tube having walls made from a combustible material. When the cartridge is fired, a darting flame is produced in the metal ignition tube which passes through the open end unhindered into the empty channel, thereby igniting all of the propellant charge surrounding the channel practically simultaneously.

8 Claims, 1 Drawing Sheet

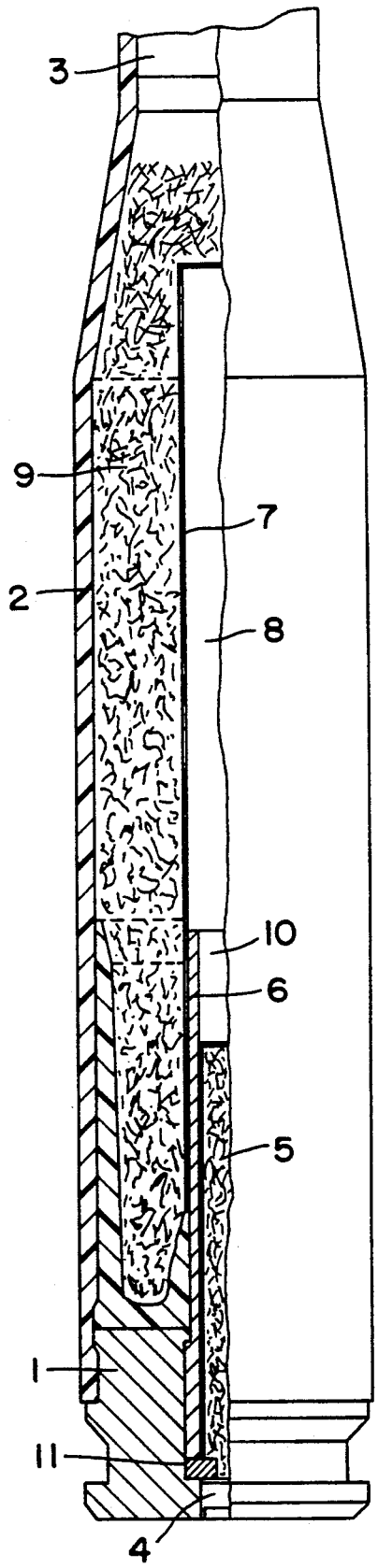
3
9
7
2
8
10
6
5
1
11
4

CARTRIDGE WITH FLASH TUBE

BACKGROUND OF THE INVENTION

The instant invention relates to a cartridge comprising a cartridge case having a primer cap at its bottom, and a metal flash tube extending into the cartridge case immediately after the primer cap. The metal flash tube extends about one-third of the length of the combustion chamber in the cartridge case and is surrounded by the propellant charge.

Conventional cartridges do not have a flash tube extending into the cartridge case. In conventional cartridges, a primer cap at the bottom of the cartridge case initially ignites the propellant charge located at the bottom of the cartridge case. The propellant charge then detonates from the bottom to the top where the projectile is located. This has the disadvantage that the combustion gases which first develop compress the layers of propellant charge located at the top of the cartridge case, thereby rendering it more difficult for these to detonate. At times, the undetonated compacted propellant mass located at the top of the cartridge case is expelled together with the projectile, the full effectiveness of the propellant charge therefore not being utilized.

In order to remedy this disadvantage, a flash or ignition tube extending into the cartridge and filled with a detonating agent is sometimes provided. See, e.g., U.S. Pat. No. 4,572,078 (Bell) which discloses a metal flash tube surrounded by propellant charge in the cartridge case. The periphery of the metal flash tube disclosed therein has perforations so that the detonating agent can ignite the propellant charge. However, this patent recognizes that a limitation of this arrangement is that there is low uniformity of propellant bed permeation by the flash produced in the flash tube. Furthermore, because of the presence of the perforations, even in this arrangement the propellant charge is ignited from the bottom of the cartridge case upwards and not suddenly all at once. While the arrangement shown in FIG. 1 of U.S. Pat. No. 4,572,078 leads to an improvement in the situation, this arrangement is not a totally satisfactory solution.

The same U.S. Pat. No. 4,572,078 also teaches that the flash tube may be omitted and the inside walls of the cartridge case can be lined with a thin layer of the detonating agent extending up from the primer cap. However, this arrangement leads not only to difficulties in manufacture but also fails to produce a truly sudden detonation of the entire propellant charge.

It is also known from DE-AS 1 296 998 that instead of a metal flash tube, a pipe-shaped sleeve made from a combustible material and containing a powder-like detonating agent can be provided, whereby a coaxial pyrophoric element is contained within the cartridge case. However, since the pipe-shaped cartridge sleeve disclosed therein only extends about one-third of the length of the cartridge case, this arrangement also produces a progressive ignition of the propelling charge, starting from the bottom of the case and up to the projectile.

It is therefore the object of the instant invention to eliminate these disadvantages and to provide a cartridge in which the sudden ignition or detonation of the propellant charge over the greatest possible surface is ensured through comparatively simple means.

SUMMARY OF THE INVENTION

This object is attained by means of the present invention according to which a cartridge comprises a cartridge case having a closed bottom, an open top, and a hollow interior, a primer cap located on the bottom of the cartridge case, a projectile received within the open top of the cartridge case, and a propellant charge contained within the hollow interior of the cartridge case up to the projectile. The inventive cartridge further comprises a metal flash tube within the cartridge case surrounded by the propellant charge. One end of the flash tube is adjacent the primer cap while a second end is open to the propellant charge. The flash tube has no perforations in its wall and its length is about one-third the length of the cartridge case. A detonating agent is contained within the flash tube, but does not completely fill it. Rather, the detonating agent is spaced at a distance from the open end of the flash tube. The inventive cartridge further comprises an empty channel formed in the propellant charge and which extends from the open end of the flash tube up to a region in proximity to the projectile.

As a result of this construction, when the cartridge is fired, a darting flame is produced in the flash tube which surges unhindered into the channel made in the propellant charge up to a region which is in proximity to the projectile. Thereby, the entire propellant charge surrounding the channel is detonated practically simultaneously. Since the flash tube is non-perforated, the propellant charge directly surrounding the flash tube is not detonated immediately, but is ignited from above. Nevertheless, this does not present a problem since gas pressure from below is not produced and does not exert a force upon the top layers of propellant charge. Furthermore, all of the propellant charge is consumed within the cartridge case and there is no mass of propellant charge which is expelled from the cartridge case together with the projectile as in conventional cartridges. Additionally, since the detonating agent does not fill the ignition tube completely, but is spaced at a distance from the end of the flash tube, this permits the complete development of the detonating or darting flame in the channel.

In a preferred embodiment of the invention, the channel is constituted by a closed tube, preferably made from a combustible material, which is mounted on the flash tube. This arrangement facilitates the manufacture of the cartridge since the powder constituting the propellant charge needs only to be filled in after the closed tube is in place. Furthermore, since the forward end of the tube in proximity to the projectile is closed, this prevents propellant charge from spilling into the tube. Additionally, the walls of the channel are stabilized when the channel is constituted by the closed tube.

BRIEF DESCRIPTION OF THE DRAWING

The drawing shows a cartridge according to the invention in partial cross-section.

DETAILED DESCRIPTION OF A PREFERRED EMBODIMENT

Referring to the drawing, the cartridge comprises a bottom piece 1 made of metal and a sleeve 2 made preferably from a synthetic material which holds the projectile 3 at the front. The primer cap 4 is located at the bottom of the cartridge. Directly after the primer cap 4, a metal flash or ignition tube 6 filled with detonating agent 5 extends into the cartridge case as far as to the middle third of the length of the combustion chamber. A second tube 7 made of a combustible material is attached to the ignition tube and extends from an open end of the ignition tube 6. The tube 7 is closed on the side facing the projectile 3 and forms a channel 8 surrounded by the propellant charge 9 and extending to within proximity of the projectile 3. The detonating agent 5 does not completely fill the flash tube 6, but ends at a distance from the outlet 10 of the flash tube. This enables a darting flame to develop fully before entering the tube 7.

In order to simplify manufacture of the cartridge, a ring 11 on which the flash tube 6 bears and which constitutes the firing channel from the primer cap 4 is embedded in the bottom piece 1. This makes it possible to omit an otherwise necessary shoulder coming in from both sides when making the bottom piece 1.

While the invention has been described by reference to a specific embodiment, this was for purposes of illustration only. Numerous alternative embodiments will be apparent to those skilled in the art.

I claim:

1. A cartridge, comprising a cartridge case having a bottom portion, a top portion, and a side wall defining a hollow interior for said cartridge case, said top portion being open and receiving a projectile therein, a propellant charge contained within said hollow interior of said cartridge case, a primer cap located on said bottom portion of said cartridge case, a hollow ignition tube contained within said cartridge case, said ignition tube having a first end in communication with said primer cap and a second end, a detonating agent contained within said ignition tube, said detonating agent filling said ignition tube from said first end up to a distance spaced from said second end of said ignition tube, and an empty channel formed in and surrounded by said propellant charge, said channel extending from said second end of said ignition tube to a region in proximity to said projectile, said second end of said ignition tube being open to said channel so that a flame produced in said ignition tube passes unhindered into said channel and detonates all of said propellant charge surrounding said channel practically simultaneously.

2. The cartridge of claim 1 wherein said ignition tube is about one-third the length of said cartridge case.

3. The cartridge of claim 1 wherein said ignition tube is made from metal.

4. The cartridge of claim 1 wherein the periphery of said ignition tube is non-perforated.

5. The cartridge of claim 1 wherein said ignition tube is surrounded by said propellant charge.

6. The cartridge of claim 1 wherein said channel is constituted by walls of a second tube mounted on said ignition tube.

7. The cartridge of claim 6 wherein said walls of said second tube are made from a combustible material.

8. The cartridge of claim 7 wherein said second tube has a closed end in proximity to said projectile.

* * * * *